US010751724B2

(12) United States Patent
Dallimore et al.

(10) Patent No.: US 10,751,724 B2
(45) Date of Patent: Aug. 25, 2020

(54) METHOD OF FEEDING MATERIAL TO A HORIZONTAL SHAFT IMPACT CRUSHER, AND A CRUSHING DEVICE

(71) Applicant: SANDVIK INTELLECTUAL PROPERTY AB, Sandviken (SE)

(72) Inventors: Rowan Dallimore, Bath (GB); Andreas Forsberg, Malmo (SE); Knut Kjaerran, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 989 days.

(21) Appl. No.: 14/410,041

(22) PCT Filed: May 24, 2013

(86) PCT No.: PCT/EP2013/060694

§ 371 (c)(1),
(2) Date: Dec. 19, 2014

(87) PCT Pub. No.: WO2013/189687

PCT Pub. Date: Dec. 27, 2013

(65) Prior Publication Data

US 2015/0122920 A1 May 7, 2015

(30) Foreign Application Priority Data

Jun. 20, 2012 (EP) ..... 12172806

(51) Int. Cl.
*B02C 13/286* (2006.01)
*B02C 13/02* (2006.01)
(Continued)

(52) U.S. Cl.
CPC ..... *B02C 13/286* (2013.01); *B02C 13/02* (2013.01); *B02C 13/095* (2013.01); *B02C 23/12* (2013.01); *B02C 2013/28672* (2013.01)

(58) Field of Classification Search
CPC ..... B02C 13/02; B02C 13/10; B02C 13/095; B02C 13/236; B02C 23/12; B02C 2013/28672; B02C 13/286
(Continued)

(56) References Cited

U.S. PATENT DOCUMENTS 1,593,491 A * 7/1926 Gerson ..... B02C 13/02 162/201
3,608,841 A * 9/1971 Wageneder ..... B02C 13/095 241/189.1
(Continued)

FOREIGN PATENT DOCUMENTS

GB 825653 A 12/1959
WO 199303844 A1 3/1993

*Primary Examiner* — Shelley M Self
*Assistant Examiner* — Smith Oberto Bapthelus
(74) *Attorney, Agent, or Firm* — Corinne R. Gorski

(57) ABSTRACT

A crushing device includes a horizontal shaft impact crusher having an impeller rotating around a horizontal shaft and at least one curtain against which material may be crushed. The crushing device further includes a first feeding device for feeding a first type of material to be crushed to a crushing chamber of the horizontal shaft impact crusher. A second feeding device feeds a second type of material, having a smaller average particle size than the first type of material, to the crushing chamber simultaneously with the first feeding device feeding the first type of material to the crushing chamber. A mixing arrangement for at least partially mixes the first and the second types of materials with each other before bringing them into contact with the impeller.

14 Claims, 9 Drawing Sheets

(51) Int. Cl.
*B02C 23/12* (2006.01)
*B02C 13/09* (2006.01)

(58) Field of Classification Search
USPC ..... 241/24.1, 186.2, 189.1
See application file for complete search history.

(56) References Cited

U.S. PATENT DOCUMENTS 3,659,691 A * 5/1972 Leutelt ..... B02C 13/286 193/2 C
4,017,035 A * 4/1977 Stuttmann ..... B02C 13/095 241/189.1
4,635,863 A * 1/1987 McCorkel ..... B02C 13/2804 241/188.1
5,402,948 A * 4/1995 Kaczmarek ..... B02C 18/144 241/186.2
5,505,390 A * 4/1996 Rodgers ..... B02C 13/06 241/152.2
5,529,250 A * 6/1996 Pallmann ..... B02C 13/286 241/186.3
5,683,044 A * 11/1997 Gueldenpfennig ..... B02C 13/04 241/14
6,070,818 A * 6/2000 Taylor ..... B02C 13/095 241/189.1
6,070,819 A * 6/2000 Young ..... B02C 13/095 241/189.1
6,189,820 B1 * 2/2001 Young ..... B02C 13/095 241/186.3
6,637,680 B1 * 10/2003 Young ..... B02C 13/095 241/186.3
7,942,356 B2 * 5/2011 Dallimore ..... B02C 13/095 241/186.3
8,490,905 B2 * 7/2013 Dallimore ..... B02C 13/095 241/101.3
2003/0065055 A1 * 4/2003 Johnston ..... B02C 19/186 523/175
2005/0258192 A1 * 11/2005 Matthews ..... A47K 5/14 222/190
2010/0147985 A1 * 6/2010 Dallimore ..... B02C 13/095 241/186.3
2010/0159247 A1 * 6/2010 Kaya ..... B02C 23/12 428/402
2011/0253821 A1 * 10/2011 Dallimore ..... B02C 13/095 241/189.1
2015/0122920 A1 * 5/2015 Dallimore ..... B02C 13/095 241/24.1
2015/0190813 A1 * 7/2015 Dallimore ..... B02C 13/095 241/5
2016/0129451 A1 * 5/2016 Dallimore ..... B02C 13/095 241/189.1
2017/0136469 A1 * 5/2017 Forsberg ..... B02C 13/26
2017/0151572 A1 * 6/2017 Dallimore ..... B02C 13/2804

* cited by examiner

METHOD OF FEEDING MATERIAL TO A HORIZONTAL SHAFT IMPACT CRUSHER, AND A CRUSHING DEVICE

RELATED APPLICATION DATA

This application is a § 371 National Stage Application of PCT International Application No. PCT/EP2013/060694 filed May 24, 2013 claiming priority of EP Application No. 12172806.7, filed Jun. 20, 2012.

TECHNICAL FIELD OF THE INVENTION

The present invention relates to a method of feeding material to be crushed to a horizontal shaft impact crusher comprising an impeller rotating around a horizontal shaft and at least one curtain against which material may be crushed.

The present invention further relates to a crushing device comprising a horizontal shaft impact crusher having an impeller rotating around a horizontal shaft and at least one curtain against which material may be crushed.

BACKGROUND ART

Horizontal shaft impact crushers (HSI-crushers) are utilized in many applications for crushing hard material, such as pieces of rock, ore etc. A HSI-crusher has an impeller that is made to rotate around a horizontal axis. Pieces of rock are fed towards the impeller and are struck by beater elements mounted on the impeller. The pieces of rock are disintegrated by being struck by the beater elements, and are accelerated and thrown against breaker plates, often referred to as curtains, against which further disintegration occurs. The action of the impeller thus causes the material fed to the horizontal shaft impact crusher to move freely in a crushing chamber and to be crushed upon impact against the beater elements, against the curtains, and against other pieces of material moving around at high speed in the crushing chamber.

U.S. Pat. No. 6,189,820 discloses a HSI-crusher having a crushing chamber in which material supplied to the crusher can be crushed. On some occasions it is difficult to adjust the curtains to obtain the desired particle size in the crushed product leaving the crusher.

SUMMARY OF THE INVENTION

It is an object of the present invention to provide a method of making it easier to obtain a desired particle size distribution when crushing material in a horizontal shaft impact crusher. This object is achieved by means of a method of feeding material to be crushed to a horizontal shaft impact crusher comprising an impeller rotating around a horizontal shaft and at least one curtain against which material may be crushed, the method comprising:

feeding a first type of material to be crushed to a crushing chamber of the horizontal shaft impact crusher, simultaneously therewith feeding a second type of material to be crushed to the crushing chamber, wherein the second type of material has a smaller average particle size than the first type of material, and at least partially mixing the first and the second types of materials with each other before bringing them into contact with the impeller.

An advantage of this method is that the wear of the internal crusher structures, including beater elements of the impeller, will be more even, which reduces the costs associated with prematurely exchanging beater elements due to uneven wear. Furthermore, by at least partly mixing the second type of material with the first type of material the second type of material will be more involved in the crushing action of the impeller, and the risk will be reduced that the second type of material slips past the impeller without being crushed. A further advantage of this method is that it provides an efficient manner of obtaining a desired particle size distribution when crushing material in a horizontal shaft impact crusher.

According to one embodiment the method further comprises feeding the second type of material on top of the first type of material to distribute objects of the second type of material in void spaces formed between objects of the first type of material. An advantage of this embodiment is that the second material will be well-distributed across the cross-section of the crushing chamber, since the first type of material will function almost as a sieve forming quite evenly distributed void spaces into which the second type of material may fall.

According to one embodiment the method further comprises feeding the first type of material and the second type of material separated from each other to a horizontal shaft impact crusher feed chute. An advantage of this embodiment is that the even distribution of the first and second materials across the cross-section of the crushing chamber is improved when materials are fed separated from each other to the feed chute. When first and second type of materials are combined already upstream of the feed chute there is a risk of material segregation, i.e., uneven distribution of materials, that is difficult to break up.

According to one embodiment the method further comprises at least partly mixing the first type of material and the second type of material with each other in a feed chute. An advantage of this embodiment is that the even distribution of the first and second materials across the cross-section of the crushing chamber is improved when mixing starts in the feed chute.

According to one embodiment the method further comprises at least partly mixing the first type of material and the second type of material with each other in an inlet portion of the crushing chamber. An advantage of this embodiment is that the even distribution of the first and second materials across the cross-section of the crushing chamber is improved when mixing occurs in the inlet portion of the crushing chamber.

According to one embodiment the method further comprises screening crushed material leaving the crushing chamber, and recirculating an oversize material fraction of the crushed material to form the second type of material and feeding the same to the crusher. An advantage of this embodiment is that a product of a very well-defined particle size distribution can be produced.

According to one embodiment the method further comprises feeding the first type of material to a first opening of a horizontal shaft impact crusher feed chute of the horizontal shaft impact crusher, and feeding the second type of material to a second opening of the feed chute. An advantage of this embodiment is that it becomes easier to evenly distribute the first and second types of materials across the cross-section of the crushing chamber.

According to one embodiment the method further comprises feeding the first type of material to a vertical first opening of the feed chute, and feeding the second type of material to a horizontal second opening of the feed chute. An advantage of this embodiment is that the second type of material may be efficiently "dropped down" into void spaces formed between objects of the first type of material, thereby achieving a particularly even distribution of the second type of material across the cross-section of the crushing chamber.

According to one embodiment the method further comprises feeding a first type of material that has a maximum particle size of 20-1200 mm, and wherein at least 75% by weight of the crushed material has a particle size of 5 mm or larger. An advantage of this embodiment is that the horizontal shaft impact crusher works particularly efficient with regard to crushing in relation to energy input in this range of particle sizes.

A further object of the present invention is to provide a crushing device adapted for receiving material to be crushed and for crushing the material in a crushing chamber to a desired particle size distribution.

This object is achieved by means of a crushing device comprising a horizontal shaft impact crusher having an impeller rotating around a horizontal shaft and at least one curtain against which material may be crushed, wherein the crushing device further comprises:

a first feeding device for feeding a first type of material to be crushed to a crushing chamber of the horizontal shaft impact crusher, a second feeding device for feeding a second type of material, having a smaller average particle size than the first type of material, to the crushing chamber simultaneously with the first feeding device feeding the first type of material to the crushing chamber, and a mixing arrangement for least partially mixing the first and the second types of materials with each other before bringing them into contact with the impeller.

An advantage of this crushing device is that the crushing chamber is utilized in an efficient manner, with relatively even wear of wear parts of the crusher. A further advantage of this crushing device is that it provides for obtaining a desired particle size distribution when crushing material in a horizontal shaft impact crusher.

According to one embodiment the second feeding device is arranged for feeding the second type of material on top of the first type of material to distribute objects of the second type of material in void spaces formed between objects of the first type of material. An advantage of this embodiment is that the second type of material will be particularly evenly distributed across the width of the crushing chamber, thereby providing for even wear of beater elements of the impeller and efficient crushing.

According to one embodiment the first and the second feeding devices are arranged for feeding the first type of material and the second type of material separated from each other to a horizontal shaft impact crusher feed chute. An advantage of this embodiment is that the supply of the first and second types of materials can be controlled more accurately, and that the distribution of the first and second materials across the cross-section of the crushing chamber is improved.

According to one embodiment the mixing arrangement comprises at least one of a horizontal shaft impact crusher feed chute and an inlet portion of the crushing chamber. An advantage of this embodiment is that mixing is accomplished just before the contact with the impeller, which reduces the risk of transport segregation effects, i.e., effects of a mixed material redistributing from an even distribution to an uneven distribution during the transport thereof.

According to one embodiment the crushing device comprises a screening device for screening crushed material, and a recirculation system for recirculating oversized material as said second type of material from the screening device to the crusher. An advantage of this crushing system is that a particularly good control of the particle size distribution of the crushed product is obtained.

Further objects and features of the present invention will be apparent from the description and the claims.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
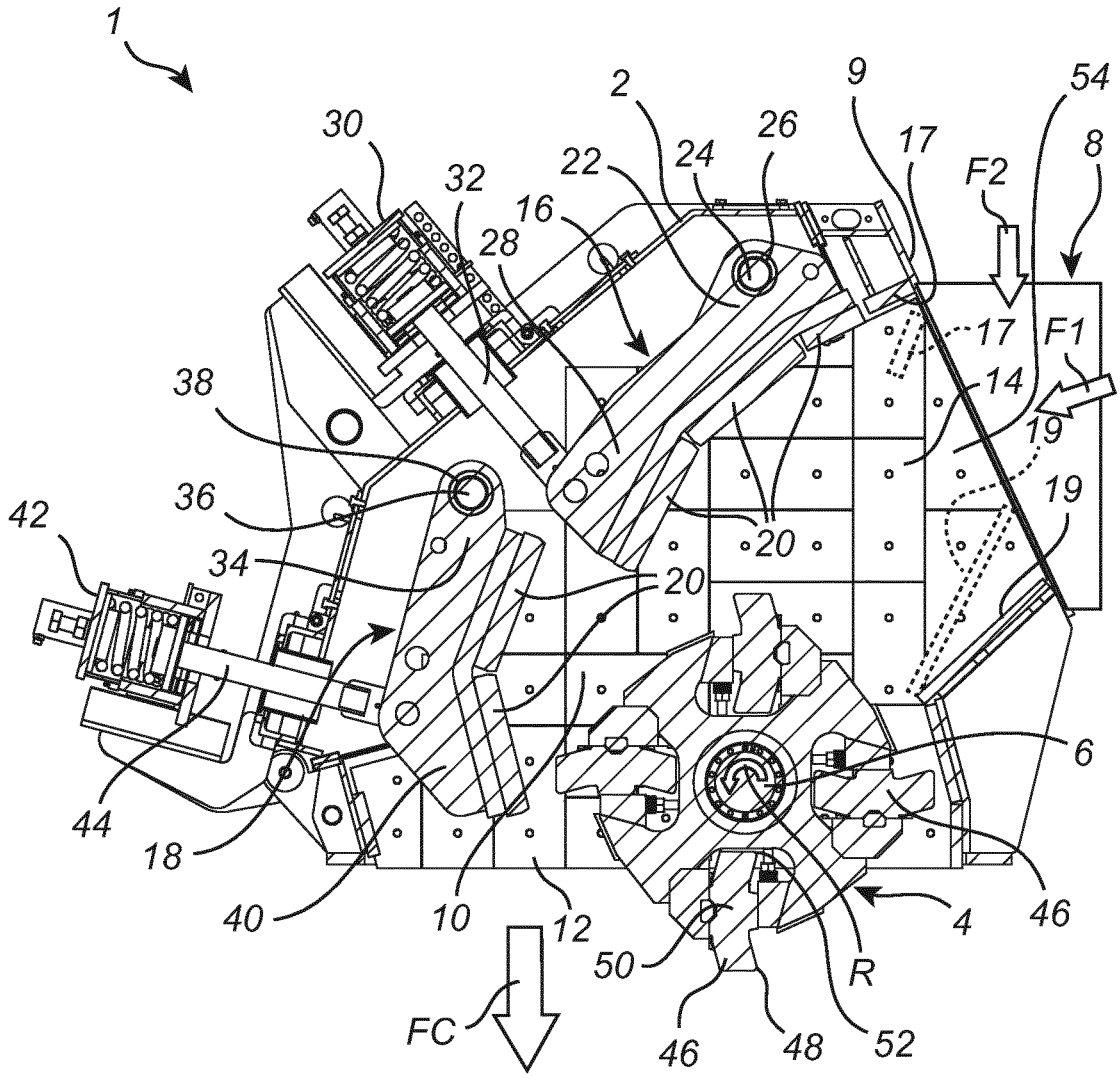
FIG. 1 is a cross-sectional side view of a horizontal shaft impact crusher.

FIG. 1 is a cross-section and illustrates, schematically, a crushing device comprising a horizontal shaft impact crusher 1 (HSI-crusher). The horizontal shaft impact crusher 1 comprises a housing 2 in which an impeller 4 is arranged. A motor, not illustrated for reasons of maintaining clarity of illustration, is operative for rotating a horizontal shaft 6 on which the impeller 4 is mounted. As alternative to the impeller 4 being fixed to the shaft 6, the impeller 4 may rotate around the shaft 6. In either case, the impeller 4 is operative for rotating around a horizontal axis, coinciding with the centre of the horizontal shaft 6.

Material to be crushed is fed to a horizontal shaft impact crusher feed chute 8, which is mounted to an inlet flange 9 of the housing 2, and enters a crushing chamber 10 which is arranged inside the housing 2 and at least partly encloses the impeller 4. Material that has been crushed leaves the crushing chamber 10 via an outlet 12 for crushed material.

The housing 2 is provided with a plurality of interior wear protection plates 14 that are operative for protecting the interior of the crushing chamber 10 from abrasion and from impact by the material to be crushed.

The crusher 1 comprises a first curtain 16, and a second curtain 18 arranged inside the crushing chamber 10. Each curtain 16, 18 comprises at least one wear plate 20 against which material may be crushed.

A first end 22 of the first curtain 16 has been mounted by means of a horizontal first pivot shaft 24 extending through an opening 26 formed in the curtain 16 at the first end 22. The first pivot shaft 24 extends further through openings in the housing 2 to suspend the first end 22 in the housing 2. A second end 28 of the first curtain 16 is connected to a first adjustment device 30 comprising at least one adjustment bar 32.

A first end 34 of the second curtain 18 has been mounted by means of a horizontal second pivot shaft 36 extending through an opening 38 formed in the curtain 18 at the first end 34. The second pivot shaft 36 extends further through openings in the housing 2 to suspend the first end 34 in the housing 2. A second end 40 of the second curtain 18 is connected to a second adjustment device 42 comprising at least one adjustment bar 44.

The impeller 4 is provided with, for example, four beater elements 46, each such beater element 46 having, for example, a "banana" shape, as seen in cross-section. An arrow R indicates the direction of rotation of the impeller 4. A leading edge 48 of the respective beater element 46 extends in the direction of the direction of rotation R. The beater element 46 is symmetric around its central portion 50 such that once the leading edge 48 has been worn out the beater element 46 can be turned and mounted with its second leading edge 52 operative for crushing material.

Optionally, the HSI-crusher 1 may be adjusted to various crusher settings depending on which type of material that is to be crushed. Hence, the crusher 1 could be adjusted to a first crushing setting, which for example may be a primary crushing setting, for crushing large objects, typically objects having a maximum particle size of 300-1200 mm, or a second crushing setting, which is different from the first crushing setting and which may be a secondary crushing setting, for crushing intermediate size objects, having a maximum particle size of less than 400 mm, typically a particle size of 20-400 mm. When the crusher 1 operates in the primary crushing setting the crushed material leaving the crusher 1 via the outlet 12 would typically have a particle size of 35-300 mm, and typically at least 75% by weight of the crushed material would have a particle size of 20 mm or larger, and when the crusher 1 operates in the secondary crushing setting the crushed material leaving the crusher 1 via the outlet 12 would typically have a particle size of 5 to 100 mm, and typically at least 75% by weight of the crushed material would have a particle size of 5 mm or larger.

For some sizes of material the crusher 1 could be set to either primary or secondary crushing setting. For example, when crushing a material having a maximum particle size of 350 mm, and the desired particle size of the crushed material is about 75 mm, then the crusher 1 would be set to a primary crushing setting, and when crushing that same material, of particle size 350 mm, and the desired particle size of the crushed material is about 25 mm, then the crusher 1 would be set to a secondary crushing setting. When crushing material having a maximum particle size of 500 mm or more, the crusher 1 would normally be arranged in the primary crushing setting, and when crushing material having a maximum particle size of 200 mm or less, the crusher 1 would be arranged in the secondary crushing setting.

Adjusting the crusher 1 to the primary crushing setting would typically involve retracting the first and/or second curtains 16, 18 away from the impeller 4, to form a crushing chamber 10 having a large volume and a large distance between the impeller 4 and the wear plates 20 of the curtains 16, 18. Such retraction of at least one curtain 16, 18 would be performed by operating the first and/or second adjustment devices 30, 42, which may, for example, as is per se known, involve hydraulic cylinders and/or mechanical adjustment devices involving threaded bars. Adjusting the crusher 1 to the secondary crushing setting would, on the other hand, typically involve moving the first and/or second curtains 16, 18 towards the impeller 4 by means of operating the first and/or second adjustment devices 30, 42, to form a crushing chamber 10 having a small volume and a short distance between the impeller 4 and the wear plates 20 of the curtains 16, 18. In addition to adjusting the position of the curtains 16, 18 also the horizontal shaft impact crusher feed chute 8 may be adjusted, as will be described hereinafter in more detail, to feed a first type of material into the crushing chamber 10 in a first direction F1 and, simultaneously with feeding the first type of material in the first direction F1, feeding a second type of material in a second direction F2. Hence, the first crushing setting is different from the second crushing setting. Furthermore, the first direction F1 of feeding material to the crusher 1 may be different from the second direction F2 of feeding material to the crusher 1.

Optionally, the adjustment of the position of the curtains 16, 18 could involve adjusting the position of one or both of the pivot shafts 24, 36 to bring the respective first ends 22, 34 closer to, or further away from, the impeller 4.

Optionally, the adjustment of the HSI-crusher 1 from a primary crushing setting to a secondary crushing setting could, in addition to adjusting the position of the curtains 16, 18 and adjusting the feed chute 8, also involve adjusting the positions of an upper feed plate 17 and a lower feed plate 19 that are located just inside of the inlet flange 9 of the housing 2 of the crusher 1. The feed plates 17, 19 protect the inlet of the housing 2, and provide the material fed to the housing 2 with a desired direction. In the illustration of FIG. 1 the upper and lower feed plates 17, 19 are adjusted to a primary crushing setting, shown in unbroken lines, with the intention of directing the coarse material fed to the crusher 1, when the crusher 1 operates in the primary crushing setting, towards both the first curtain 16 and the impeller 4. The positions of the upper and lower feed plates 17, 19 in a secondary crushing setting are indicated with broken lines in FIG. 1. As can be seen the upper and lower feed plates 17, 19 are, in the secondary crushing setting, arranged for directing the material directly towards the impeller 4. In this manner, the rather fine material fed when the crusher 1 operates in the secondary crushing setting will receive more "hits" from the beater elements 46 of the impeller 4, leading to a greater reduction in the size of the material. The upper and lower feed plates 17, 19 may, hence, be adjustable for providing the feed material with a first direction towards the impeller 4 in the primary crushing setting, and for providing the feed material with a second direction, being different from the first direction, towards the impeller 4 in the secondary crushing setting.

In operation the first type of material to be crushed is fed to the horizontal shaft impact crusher feed chute 8 and further into the crushing chamber 10 in the direction F1 and, simultaneously therewith, the second type of material is fed to the horizontal shaft impact crusher feed chute 8 and further into the crushing chamber 10 in the direction F2. The first and second types of materials will mix in the feed chute 8 and/or in the inlet portion 54 of the crushing chamber 10. Hence, the fed chute 8 will form a part of a mixing arrangement, and so will the inlet portion 54. The mixed material will then reach that part of the crushing chamber 10 which is located adjacent to the first curtain 16, being located upstream of the second curtain 18 as seen with respect to the direction of travel of the material. The impeller 4 rotates at, typically, 400-850 rpm. When the material is hit by the beater elements 46 of the impeller 4 it will be crushed and accelerated against the wear plates 20 of the first curtain 16 where further crushing occurs. The material will bounce back from the first curtain 16 and will be crushed further against material travelling in the opposite direction and, again, against the beater elements 46. When the material has been crushed to a sufficiently small size it will move further down the crushing chamber 10, and will be accelerated, by means of the beater elements 46, towards the wear plates 20 of the second curtain 18, being located downstream of the first curtain 16. Hence, the material will move freely around in the crushing chamber 10, and will be crushed against the beater elements 46, against the wear plates 20 of the curtains 16, 18, and against other pieces of material circling around, at a high velocity, in the crushing chamber 10. When the material has been crushed to a sufficiently small size it will leave the crushing chamber 10 via the outlet 12 as a flow of crushed material FC.

Figure 2A:
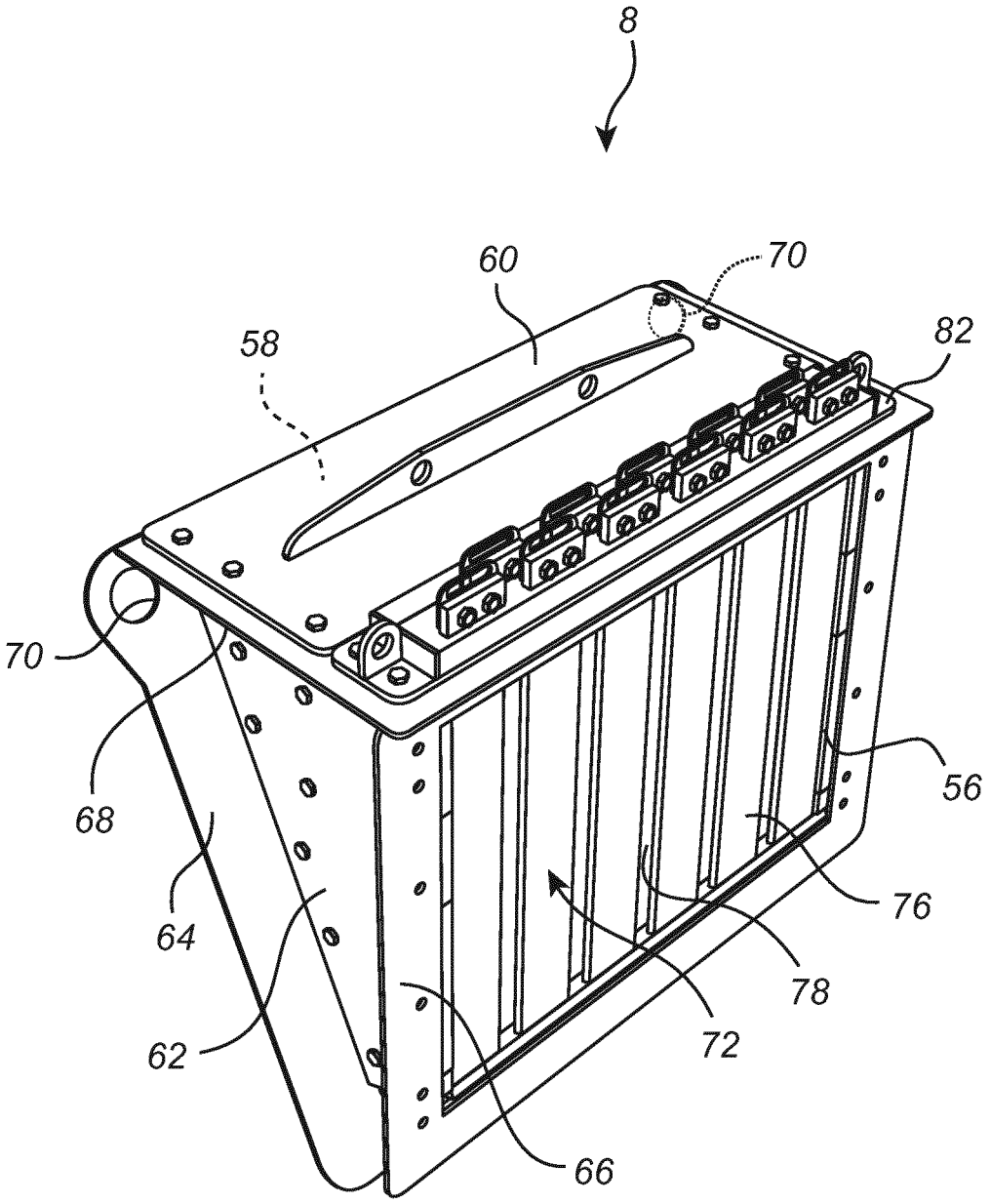
FIG. 2*a* is a three-dimensional view and illustrates a horizontal shaft impact crusher feed chute, when in a primary crushing setting.
Figure 2B:
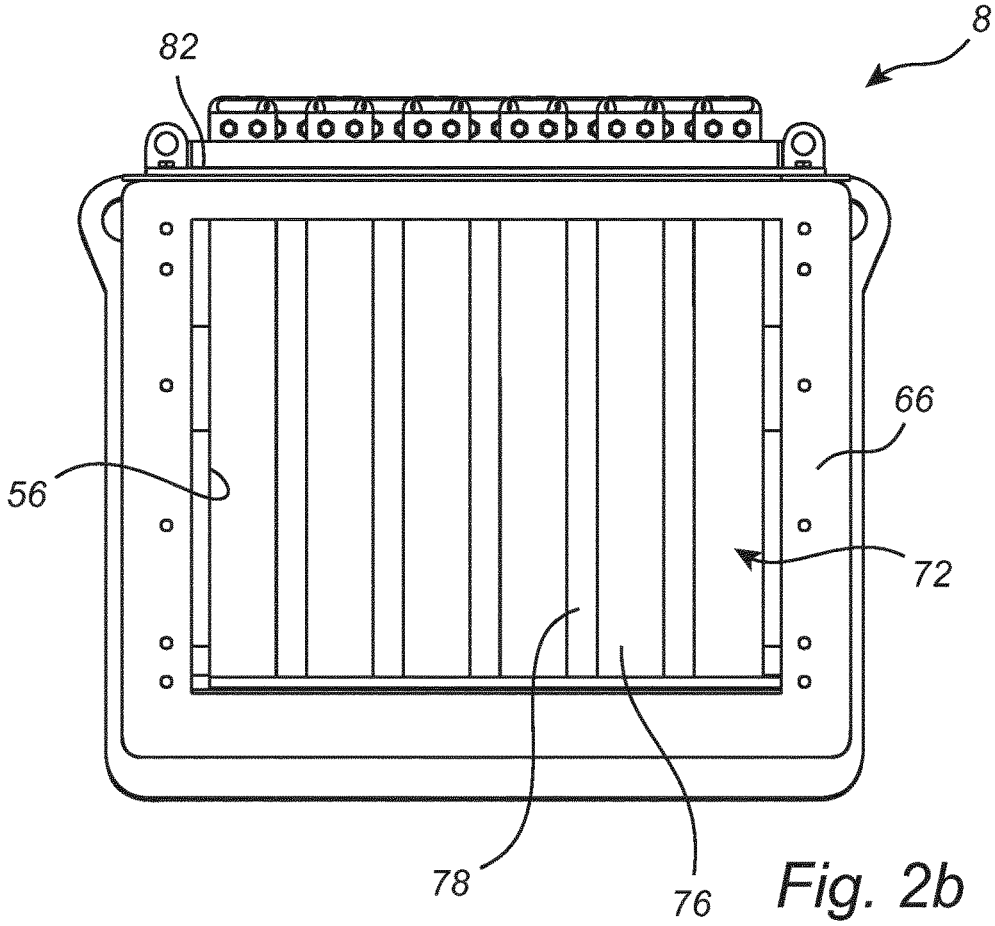
FIG. 2*b* is a front view of the horizontal shaft impact crusher feed chute of FIG. 2*a*, when in the primary crushing setting.
Figure 2C:
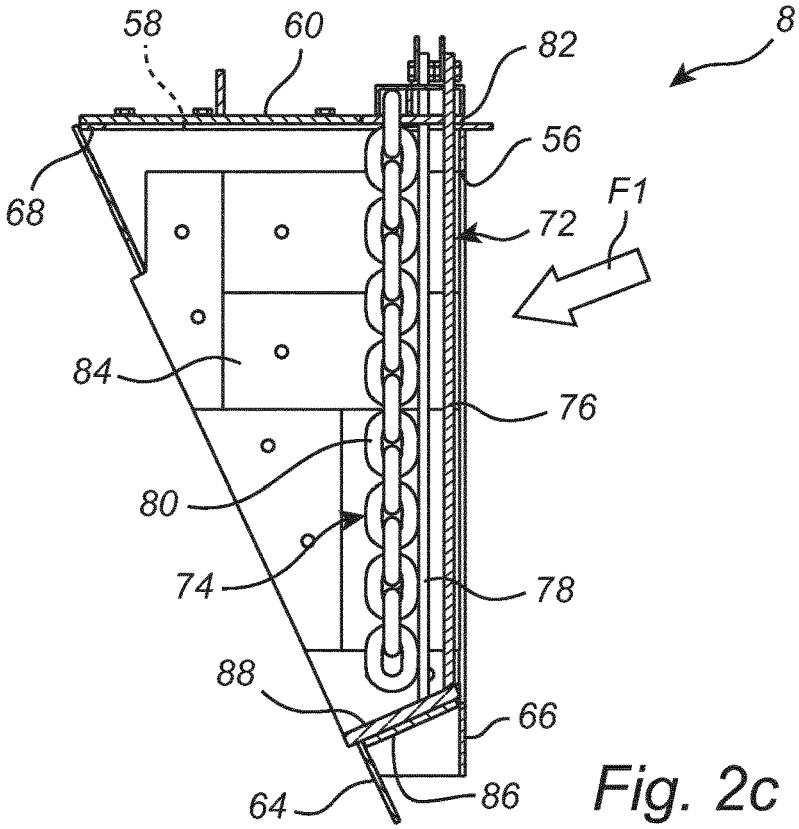
FIG. 2*c* is a cross-sectional view, and illustrates the horizontal shaft impact crusher feed chute of FIG. 2*a*, in the primary crushing setting.

FIGS. 2*a-c* illustrate the horizontal shaft impact crusher feed chute 8 when arranged in a primary crushing setting. The feed chute 8 comprises a vertical first opening 56 adapted for the primary crushing setting, and a horizontal second opening 58, which is different from the first opening 56 and is adapted for the secondary crushing setting. The first opening 56 is separated from the second opening 58. In the illustration of FIGS. 2*a-c* the feed chute 8 is in the primary crushing setting and a first cover (not shown in FIGS. 2*a-c*) has been removed from the vertical first opening 56. A second cover in the form of a hatch 60 has been mounted over the horizontal second opening 58, such that material may not enter or leave via the second opening 58.

The arrow F1 illustrates, in FIG. 2*c*, the at least partly horizontal direction of feeding material to the feed chute 8 via the first opening 56 during operation in the primary crushing setting. In accordance with one embodiment, a first type of material and a second type of material could both be fed, simultaneously, to the crushing chamber 10 via the first opening 56 of the feed chute 8, in the direction of the arrow F1.

The feed chute 8 comprises two parallel side walls 62, of which only one side wall 62 is visible in FIG. 2*a*, which connects a crusher mounting device, having the form of a crusher mounting flange 64, to the first opening 56, a first cover mounting device, having the form of a first opening flange 66, the second opening 58, and a second cover mounting device, having the form of a second opening flange 68. The crusher mounting flange 64 is arranged for mounting the feed chute 8 to the inlet flange 9 of the housing 2 of the horizontal shaft crusher 1. The first opening flange 66 is arranged for mounting the first cover over the vertical first opening 56. The second opening flange 68 is arranged for mounting the second cover, i.e., the hatch 60 over the horizontal second opening 58. In the embodiment of FIGS. 2*a-c*, the side wall 62 has a generally triangular shape, with the base of the triangle located adjacent to the horizontal second opening 58, and the point of the triangle pointing downwards, as best shown in FIGS. 2*a* and 2*c*. The crusher mounting flange 64 is, hence, inclined relative to the first opening flange 66. As shown in FIG. 1, the housing 2 is, at the connection to the feed chute 8, also inclined, such that the vertical first opening 56 of the feed chute 8 will be vertical, and the horizontal second opening 58 will be horizontal when the feed chute 8 is mounted to the housing 2 via the crusher mounting flange 64. Returning to FIG. 2*a*, the crusher mounting flange 64 is provided with locating openings 70 adapted for co-operating with locating studs (not shown) on the housing 2 of the crusher 1 to make correct mounting of the feed chute 8 on the housing 2 easier.

The feed chute 8 is provided with a first crushing chamber shield 72, which is shown in FIGS. 2*a-c*, and a second crushing chamber shield 74, which is best shown in FIG. 2*c*. The crushing chamber shields 72, 74 are flexible, and are arranged for allowing material to enter the vertical first opening 56 of the feed chute 8 when material is fed to the crusher 1, and to prevent material moving around freely inside of the crushing chamber 10 from being thrown out of the crushing chamber 10 via the feed chute 8. The first crushing chamber shield 72 comprises a first row of vertical rubber strips 76 and a second row of vertical rubber strips 78, with the first and second rows of rubber strips 76, 78 being arranged in an overlapping manner. The second crushing chamber shield 74 comprises a number of vertical chains 80. Both the first and second rows of rubber strips 76, 78 and the chains 80 are suspended from a front roof portion 82 of the feed chute 8, the front roof portion 82 being located adjacent to the vertical first opening 56. The rubber strips of the first and second rows of rubber strips 76, 78 can be moved to the sides, such that material may enter between adjacent strips. In a similar manner material may enter between adjacent chains 80. In accordance with alternative embodiments, only one of the crushing chamber shields 72, 74 may be utilized, although the embodiment of FIGS. 2*a-c* with two crushing chamber shields 72, 74 is often preferable due to the high momentum of the pieces of material moving around in the crushing chamber 10 during primary crushing.

The side walls 62 of the feed chute 8 are covered, on their respective inner sides and as illustrated in FIG. 2*c*, with interior wear protection plates 84 that may be of a similar design as the interior wear protection plates 14 of the crushing chamber 10. Furthermore, a floor portion 86 of the feed chute 8 may be covered by a bottom plate 88 of wear resistant material.

Figure 3A:
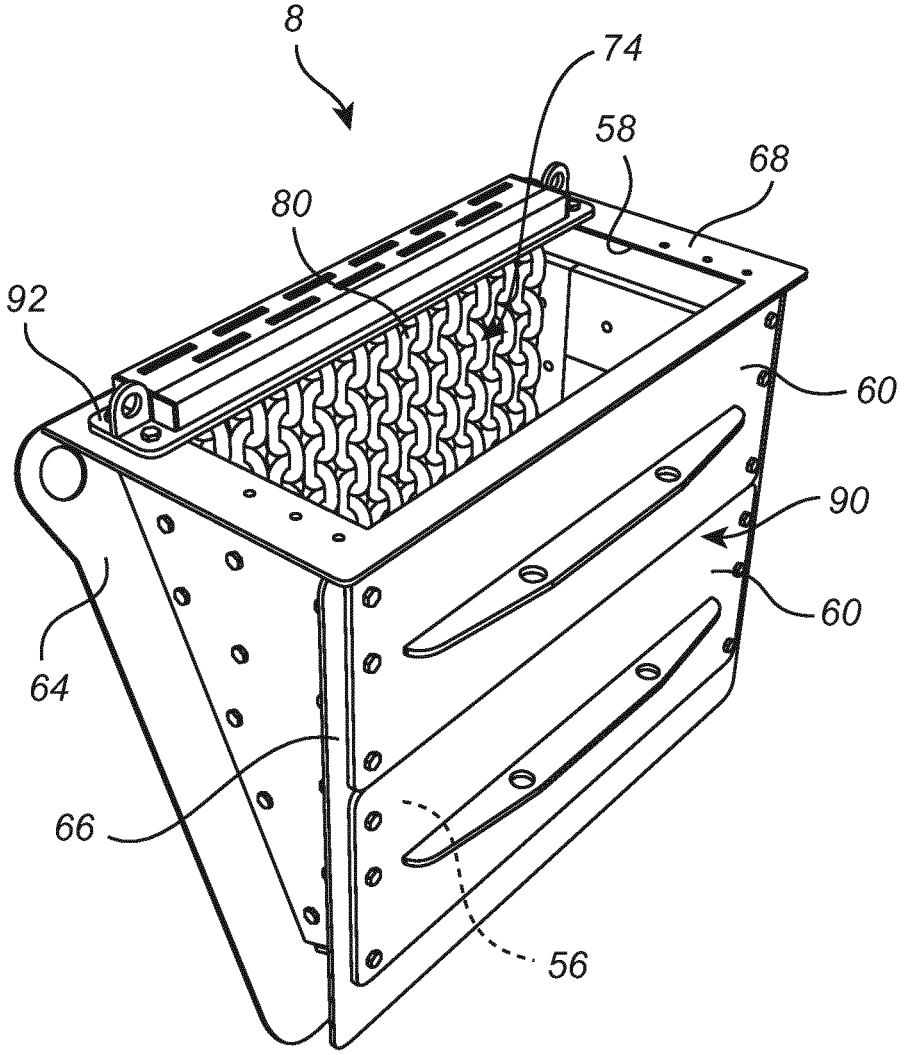
FIG. 3*a* is a three-dimensional view and illustrates the horizontal shaft impact crusher feed chute, when in a secondary crushing setting.
Figure 3B:
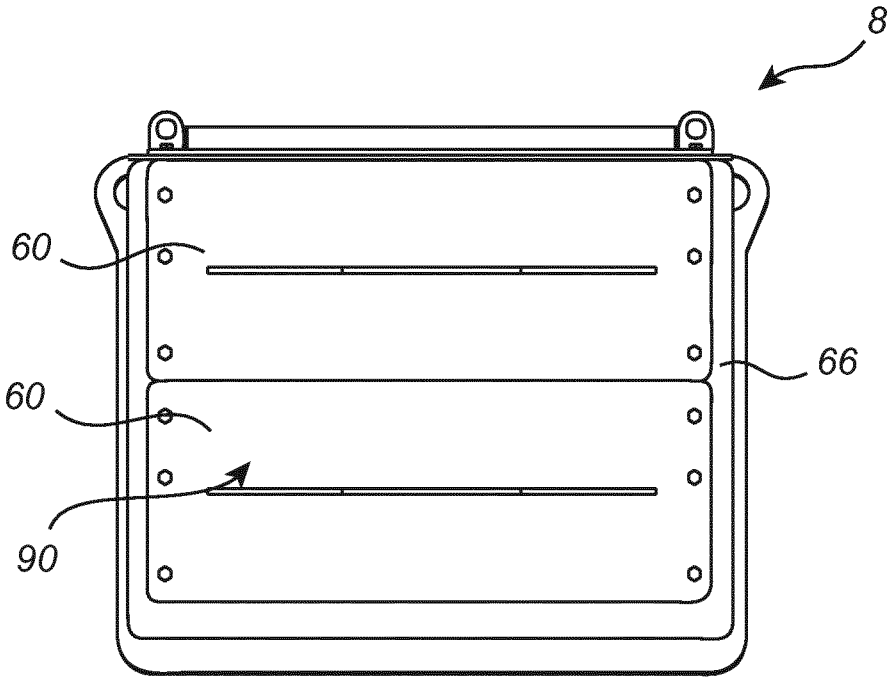
FIG. 3*b* is a front view of the horizontal shaft impact crusher feed chute of FIG. 3*a*, when in the secondary crushing setting.
Figure 3C:
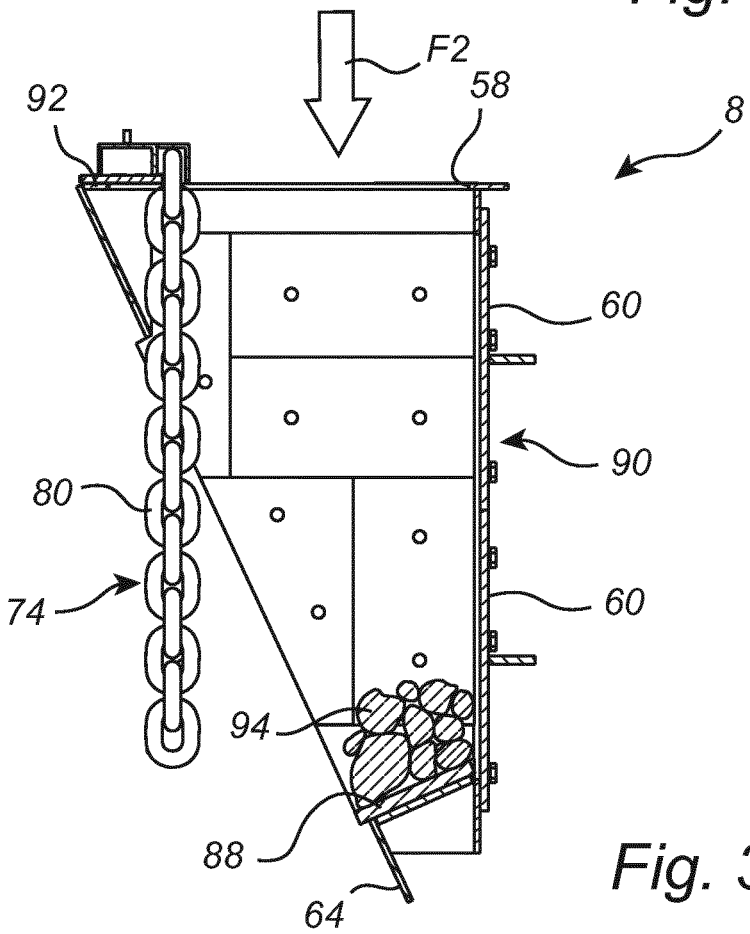
FIG. 3*c* is a cross-sectional view, and illustrates the horizontal shaft impact crusher feed chute of FIG. 3*a*, in the secondary crushing setting.

FIGS. 3*a-c* illustrate the horizontal shaft impact crusher feed chute 8 when arranged in a secondary crushing setting. In the secondary crushing setting the second cover, i.e., the hatch 60, shown in FIG. 2*a*, has been removed from the horizontal second opening 58. The first cover 90 has been mounted to the first opening flange 66 to cover the vertical first opening 56, such that material may not enter or leave via the first opening 56. In accordance with one embodiment, the first cover 90 comprises, as best illustrated in FIGS. 3*a* and 3*b*, a first hatch 60 and a second hatch 60, each of which has the same design as the hatch 60 used as the second cover in the primary crushing setting illustrated in FIGS. 2*a-c*. Hence, one of the two hatches 60 forming the first cover 90 covering the first opening 56 in the secondary crushing setting could be used, in this embodiment, as the second cover covering the second opening 58 in the primary crushing setting. Thus, one hatch 60 is adapted to at least partly cover the first opening 56 in a first mounting position, in the secondary crushing setting, and to at least partly cover the second opening 58 in a second mounting position, in the primary crushing setting.

The arrow F2 illustrates, in FIG. 3*c*, the essentially vertical direction of feeding material to the feed chute 8 via the second opening 58 during operation in the secondary crushing setting. In accordance with one embodiment, a first type of material and a second type of material could both be fed, simultaneously, to the crushing chamber 10 via the second opening 58 of the feed chute 8, in the direction of the arrow F2.

In the secondary crushing setting the feed chute 8 is provided with only the second crushing chamber shield 74, comprising the vertical chains 80, for allowing material to enter the horizontal second opening 58 of the feed chute 8, and to prevent material moving around freely inside the crushing chamber 10 from being thrown out of the crushing chamber 10 via the feed chute 8. The chains 80 are suspended from a rear roof portion 92 of the feed chute 8, the rear roof portion 92 being different from the front roof portion 82 and being located adjacent to the crusher mounting flange 64. In accordance with an alternative embodiment, both the first and second crushing chamber shields 72, 74 may be utilized, although utilizing only the second crushing chamber shield 74 as illustrated in FIG. 3*c* is often sufficient to prevent pieces of material from being thrown out of the crushing chamber 10 via the feed chute 8 when operating in the secondary crushing setting.

During operation of the crusher in the secondary crushing setting the bottom plate 88 of wear resistant material would typically become covered with a bed 94 of material, which would protect the bottom plate 88 and also other parts of the feed chute 8 from wear. The build up of the bed 94 of material may be promoted by the lower feed plate 19, illustrated in FIG. 1, since the lower feed plate 19 may form, together with the bottom plate 88 and the first cover 90, a "pocket" efficiently collecting material and forming the bed 94.

The horizontal shaft impact crusher feed chute 8 makes it very easy to shift between operation in a first crushing setting, such as primary crushing setting, and operation in a second crushing setting, such as secondary crushing setting.

When shifting from primary crushing setting, illustrated in FIGS. 2*a-c*, to secondary crushing setting, illustrated in FIGS. 3*a-c*, the hatch 60 is removed from the second opening 58, this hatch 60, plus another hatch 60, are mounted, as the first cover 90, over the first opening 56, the first crushing chamber shield 72 is removed, the second crushing chamber shield 74 is moved from the position at the front roof portion 82 to the position at the rear roof portion 92, and the feed chute 8 is ready for crushing in the secondary crushing setting.

When shifting from secondary crushing setting, illustrated in FIGS. 3*a-c*, to primary crushing setting, illustrated in FIGS. 2*a-c*, the hatches 60 forming the first cover 90 are removed from the first opening 56, one of these hatches 60 is mounted, as the second cover, over the second opening 58, the first crushing chamber shield 72 is installed at the front roof portion 82, the second crushing chamber shield 74 is moved from the position at the rear roof portion 92 to the position at the front roof portion 82, and the feed chute 8 is ready for crushing in the primary crushing setting.

Hence, shifting between primary and secondary crushing setting can be made by simply moving hatches 60 and shields 72, 74, without any need to replace or rebuild the feed chute 8 itself.

Figure 4:
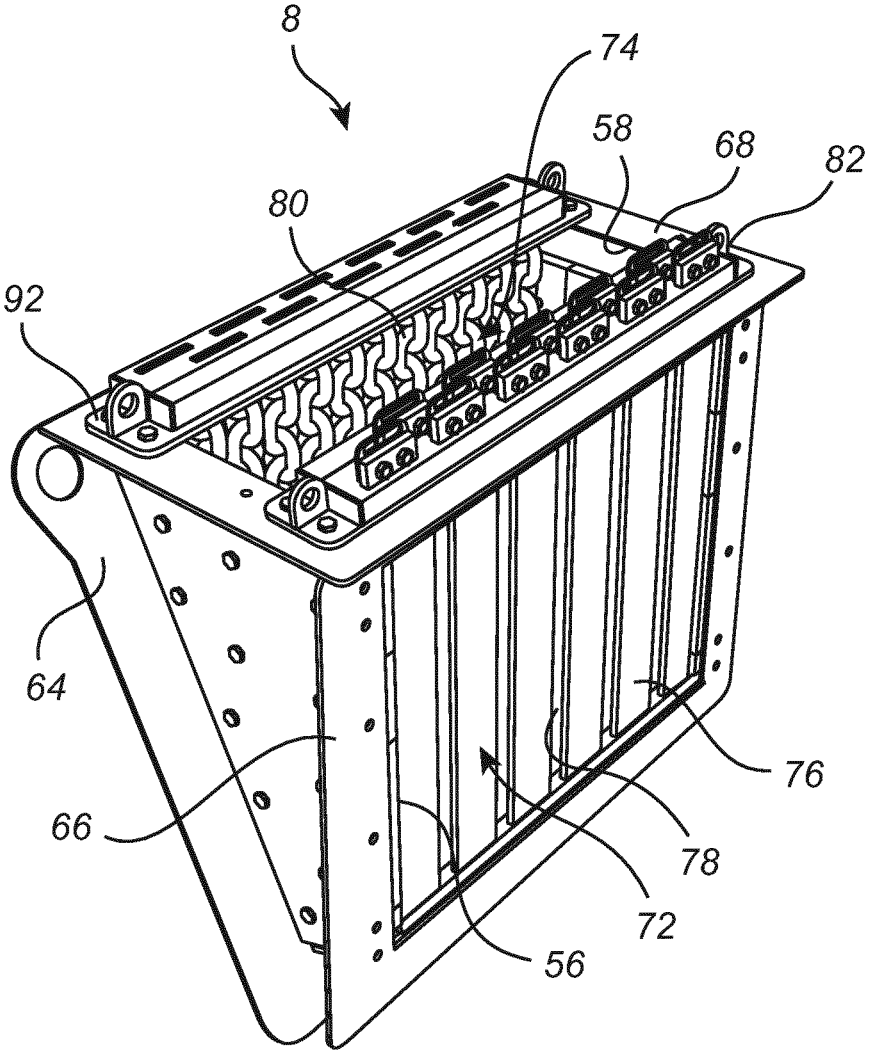
FIG. 4 is a three-dimensional view and illustrates the horizontal shaft impact crusher feed chute, when in a dual feed crushing setting.

FIG. 4 illustrates the horizontal shaft impact crusher feed chute 8 when arranged in a dual feed crushing setting. In the dual feed crushing setting illustrated in FIG. 4 the first cover 90, shown hereinbefore in FIG. 3*a*, has been removed from the first opening flange 66 to uncover the vertical first opening 56, and the second cover, i.e., the hatch 60, shown hereinbefore in FIG. 2*a*, has been removed from the second opening flange 68 to uncover the horizontal second opening 58.

In the dual feed crushing setting illustrated in FIG. 4 the feed chute 8 is provided with the first crushing chamber shield 72 arranged at the front roof portion 82 and comprising the first and second rows of rubber strips 76, 78, and the second crushing chamber shield 74 arranged at the rear roof portion 92 and comprising the vertical chains 80, for allowing material to enter the openings 56 and 58 of the feed chute 8, and to prevent material moving around freely inside the crushing chamber 10 from being thrown out of the crushing chamber 10 via the feed chute 8.

Returning to FIG. 1, and considering a crusher operating condition in which the feed chute 8 is arranged in the dual feed crushing setting illustrated in FIG. 4, a first type of material could be fed to the feed chute 8 via the first opening 56 in a direction having an at least partly horizontal direction as represented by the arrow F1 of FIG. 1, and, simultaneously with feeding the first type of material via the first opening 56, a second type of material could be fed to the feed chute 8 via the second opening 58 in an essentially vertical direction as represented by the arrow F2 of FIG. 1. The first and second types of materials mix at least partly in the feed chute 8 and/or in the inlet portion 54 and are then crushed in the crushing chamber 10 of the crusher 1. The two types of materials fed via the respective openings 56, 58 of the feed chute 8 could, for example, be two different materials, that have different size distribution, and/or different chemical composition, and/or are different types of minerals, that are intended for being crushed and for forming a mixed crushed product. If the first and second types of materials have different size distributions it is preferable that the material with the smaller average particle size is fed on top of the material with the larger average particle size, in accordance with principles that will be described in more detail hereinafter. In this disclosure, "average particle size" refers to weight based average particle size. Particle size distributions could, for example, be measured according to European standard EN 12620.

Figure 5:
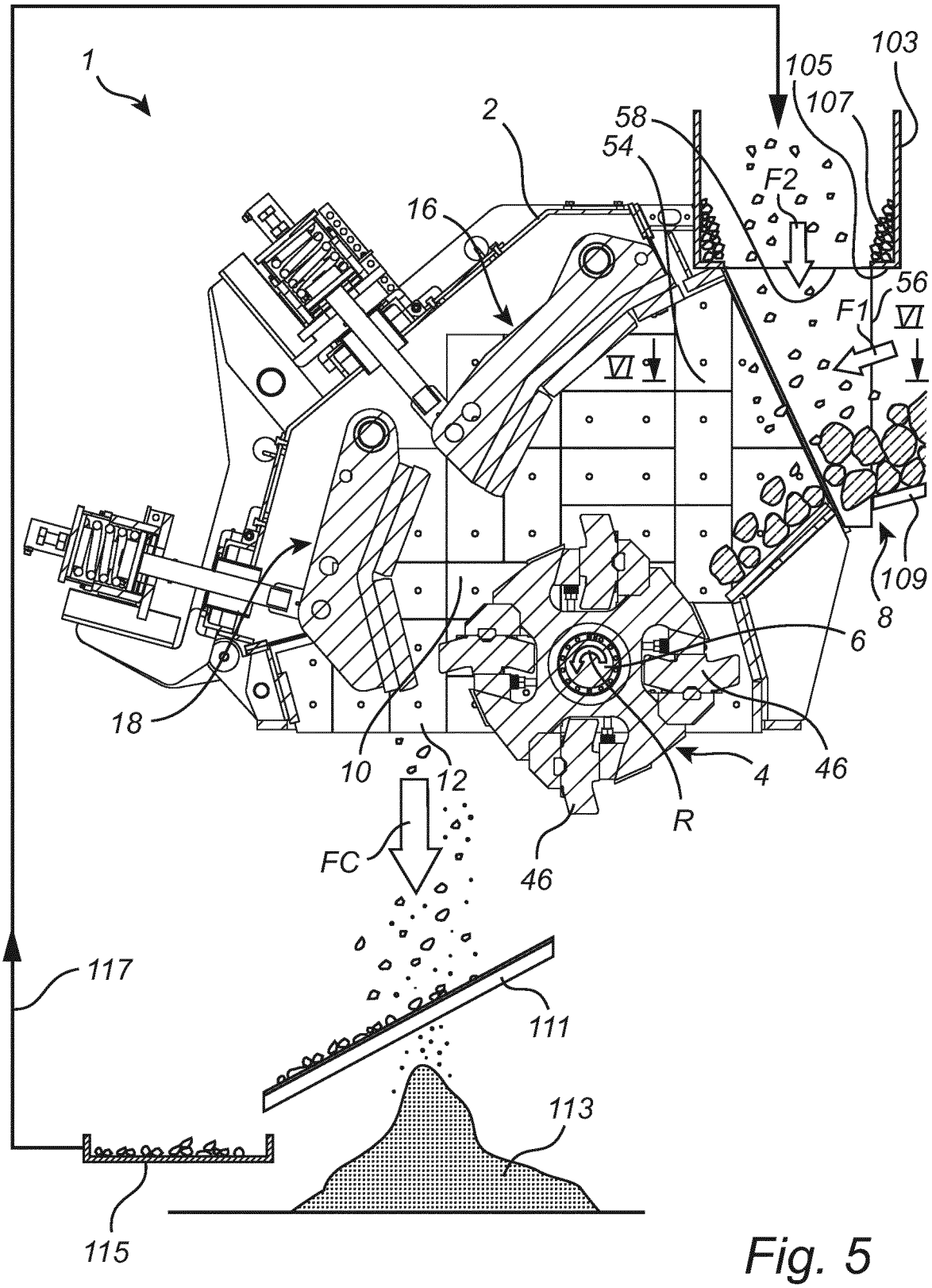
FIG. 5 is a cross-sectional side view of the horizontal shaft impact crusher when operating in the dual feed crushing setting with a partial recirculation of crushed product.

FIG. 5 illustrates an alternative embodiment of operating the horizontal shaft impact crusher 1 with dual feed crushing setting and at least a partial recirculation of crushed product. The horizontal shaft impact crusher 1 illustrated in FIG. 5 is similar to the crusher 1 illustrated in FIG. 1 and comprises a housing 2, curtains 16, 18, and an impeller 4 rotating around a shaft 6 and having beater elements 46. A horizontal shaft impact crusher feed chute 8 of the crusher 1 of FIG. 5 is arranged in the dual feed crushing setting described hereinbefore with reference to FIG. 4, which means that the first opening 56 and the second opening 58 of the feed chute 8 are both uncovered.

A feed hopper 103 is mounted to the second opening 58 of the feed chute 8. The feed hopper 103 has a horizontal bottom 105 encircling the second opening 58. During operation material may be collected on the horizontal bottom 105 to form a rock bed 107 which protects the feed hopper 103 and the opening 58 from wear.

A first feeding device 109 is arranged for feeding a first type of material in the direction F1, which is an at least partly horizontal direction, to the vertical first opening 56 of the feed chute 8. The first type of material supplied via the first feeding device 109 may, for example, have a maximum particle size of 20-1200 mm, more typically, the first type of material would have a maximum particle size of 40-1000 mm. Depending on the particle size of the first type of material, the positions of the curtains 16, 18 could be adjusted for optimum crushing performance. The first feeding device 109 could, for example, be a conveyor belt or, in particular if the first type of material has a maximum particle size of 300 mm or more, a grizzly screen conveyor comprising a number of parallel bars. In accordance with one example the first type of material is a material with a maximum particle size of 500 mm.

A screening device in the form of a product sieve 111 is arranged just below the outlet 12. The product sieve 111 screens the flow of crushed material FC. The product sieve 111 has a certain mesh size, and material having a size which is smaller than the mesh size will pass through the sieve 111 and end up as final crushed product 113. Typically, the mesh size of the product sieve 111 would be in the range of 20-100 mm. In accordance with the present example, the product sieve 111 may have a mesh size of 40 mm. Oversized material, i.e., crushed material FC having a size which is larger than, in this example, 40 mm will not pass through the sieve 111, but will be forwarded to reject material container 115. A second feeding device functioning as a recirculation system and having the form of a conveyor system 117, which is illustrated schematically in FIG. 5, transports the oversized crushed material from the reject material container 115 and recirculates the oversized material to the feed hopper 103. The oversized material is, hence, fed as a second type of material to the horizontal second opening 58 of the feed chute 8. In the embodiment of FIG. 5 the first type of material is a fresh feed of coarse material to be crushed, fed to the crusher 1 via the first feeding device 109, and the second type of material is recirculated material from the crusher 1, i.e., material that has undergone crushing in the crushing chamber 10 of the crusher 1 but which is still not sufficiently small in size, fed to the crusher 1, in the vertical downward direction F2, via the second feeding device 117. Typically, the second type of material, fed in the direction F2, would amount to about 5-40%, typically about 25%, by weight of the first type of material, fed in the direction F1. The first type of material and the second type of material are fed separated from each other, via separate feeding devices 109, 117, to the horizontal shaft impact crusher feed chute 8, and mix with each other in the feed chute 8 and in the inlet portion 54 of the crushing chamber 10. Using the arrangement of FIG. 5 makes it particularly efficient to obtain a product of a desired size. In order to obtain a crushed product of average particle size 30 mm in prior art crushing it could be necessary to set a shortest distance between impeller and second curtain of, typically, 20 mm. With the arrangement of FIG. 5 the shortest distance between the impeller 4 and the second curtain 18 could be set to 45 mm, and still result in a final crushed product 113 having the required average particle size of 30 mm, at a lower energy consumption and/or at a larger throughput of material compared to the prior art.

Figure 6:
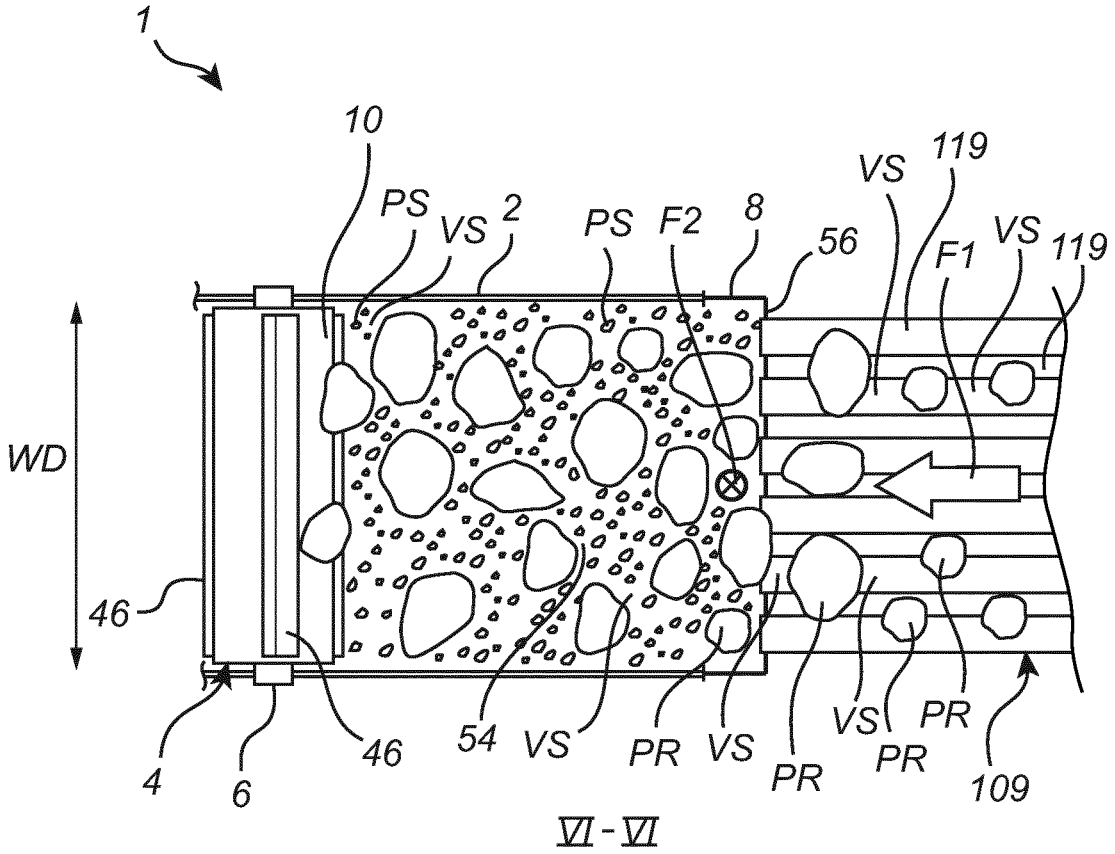
FIG. 6 is a partial top view and illustrates feeding of material to the crusher as seen in the direction of the arrows VI-VI of FIG. 5.

FIG. 6 is a partial top view as seen in the direction of the arrows VI-VI of FIG. 5, i.e., as seen from above, and illustrates feeding of material to the crusher 1. The first type of material, i.e., coarse material to be crushed, is conveyed over parallel bars 119 of the grizzly screen conveyor 109 towards the first opening 56 of the feed chute 8, in the first direction F1. Between adjacent objects, which may be called pieces of rock PR, of the first type of material void spaces VS are formed. The second type of material, i.e., oversized material recirculated via the second feeding device 117 shown in FIG. 5, is fed vertically downwards in the second direction F2, this second direction F2 being perpendicular to the plane of the illustration of FIG. 6, to the feed chute 8. The second type of material may, in this example, have an average particle size of 60 mm. Inside of the feed chute 8 the second type of material is fed on top of the first type of material, as is also shown in FIG. 5. Objects, which may be called pebbles PS, of the oversized material, i.e., the second type of material, fed vertically downwards in the second direction F2 will fall into the void spaces VS between the pieces of rock PR of the first type of material. This process starts in the feed chute 8 and may continue also in the inlet portion 54 of the crushing chamber 10. The fact that the pebbles PS are distributed in the void spaces VS between the pieces of rock PR results in an even distribution of the pebbles PS across the width WD of the crushing chamber 10 inside of the housing 2 of the crusher 1. Hence, the first type of material, which is the coarse material fed in the direction F1, has a larger average particle size than the second type of material, which is the recirculated oversized material fed in the direction F2 on top of the first type of material, and form void spaces VS that aids in the distribution of the second type of material across the width WD of the crushing chamber 10.

The mixture of the first and second types of material then reaches the impeller 4, is impacted by the beater elements 46, and crushing commences. The fact that the first and second types of materials are both evenly distributed across the width WD of the crushing chamber 10 makes crushing more efficient, and reduces the risk of uneven wear on the beater elements 46. By at least partly mixing the second type of material with the first type of material the second type of material will be more involved in the crushing action of the impeller 4, and the risk will be reduced that the second material slips past the impeller 4 without being crushed. Furthermore, objects of the second type of material will be more exposed to impact by the objects of the first type of material moving around inside the crushing chamber, such impact increasing the efficiency of the crushing of the second type of material.

Figure 7:
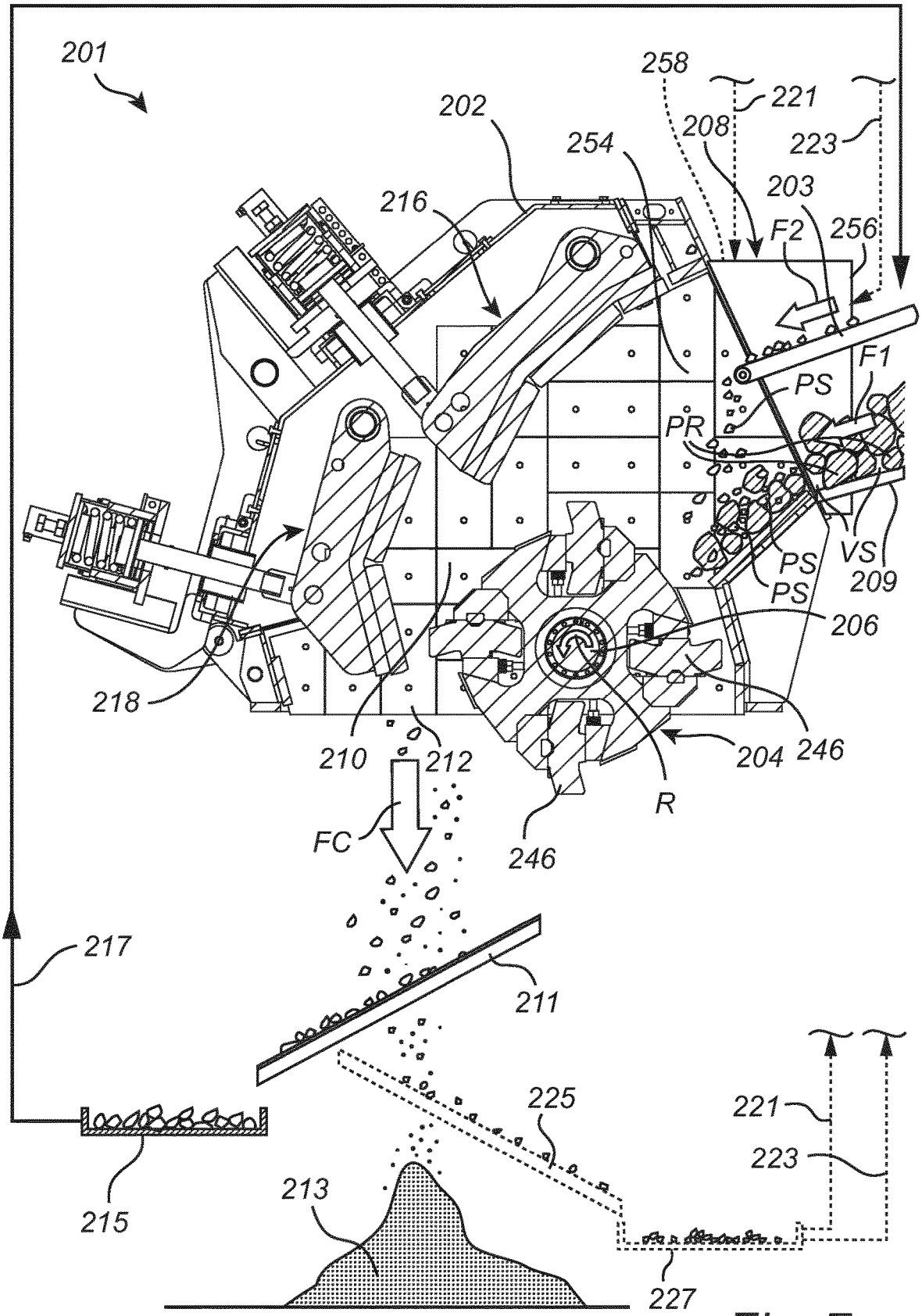
FIG. 7 is a cross-sectional side view of a horizontal shaft impact crusher in accordance with an alternative embodiment when operating in dual feed crushing setting with partial recirculation of crushed product.

FIG. 7 illustrates an alternative embodiment of a horizontal shaft impact crusher 201 with dual feed and at least a partial recirculation of crushed product. The horizontal shaft impact crusher 201 illustrated in FIG. 7 is similar to the crusher 1 illustrated in FIG. 1 in many aspects and comprises a housing 202, curtains 216, 218, and an impeller 204 rotating around a shaft 206 and having beater elements 246. A horizontal shaft impact crusher feed chute 208 differs from the feed chute 8 described hereinbefore in that the feed chute 208 is provided with a vertical opening 256, but may not necessarily have any horizontal opening.

A first feeding device 209 is arranged for feeding a first type of material to the vertical opening 256 of the feed chute 208 in the direction F1, which is an at least partly horizontal direction. The first type of material supplied via the first feeding device 209 may, for example, have a maximum particle size of 20-1200 mm, more typically, the first type of material would have a maximum particle size of 40-1000 mm. Depending on the maximum particle size of the first type of material, the positions of curtains 216, 218 could be adjusted for optimum crushing performance. The first feeding device 209 could, for example, be a conveyor belt or, in particular if the first type of material has a maximum particle size of 300 mm or more, a grizzly screen conveyor comprising a number of parallel bars. In accordance with one example the first type of material is a material with a maximum particle size of 500 mm.

A product sieve 211 is arranged just below an outlet 212 of a crushing chamber 210 of the crusher 201. The product sieve 211 screens the flow of crushed material FC in accordance with similar principles as described hereinbefore with reference to FIG. 5. Crushed material of a desired size is collected as final product 213. Oversized material, i.e., crushed material FC having a size which is larger than, for example, 40 mm will not pass through the sieve 211, but will be forwarded to reject material container 215. A second feeding device functioning as a recirculation system and having the form of a conveyor system 217, which is illustrated schematically in FIG. 7, transports the oversized crushed material from the reject material container 215 and recirculates the oversized material to a conveyor belt 203 comprised in the second feeding device 217. The conveyor belt 203 feeds the recirculated oversized material, as a second type of material, to the vertical opening 256. Hence, in the embodiment of FIG. 7 a first type of material is a fresh feed of coarse material to be crushed, fed to the crusher 201 via the first feeding device 209, and the second type of material is recirculated material from the crusher 201, i.e., material that has undergone crushing in the crushing chamber 210 of the crusher 201 but which is still not sufficiently small in size, fed to the crusher 201 via the second feeding device 217 and the conveyor belt 203. The first type of material and the second type of material are fed separated from each other, via separate feeding devices 209, 217, to the horizontal shaft impact crusher feed chute 208, and mix with each other in the feed chute 208 and in the inlet portion 254 of the crushing chamber 210. In the embodiment of FIG. 7 the second type of material falls off from the conveyor belt 203 at the inlet portion 254, but it will be appreciated that the second type of material could, in an alternative embodiment, fall off from the conveyor belt 203 already inside the feed chute 208.

The first type of material, i.e., coarse material to be crushed, is conveyed by the conveyor 209, which could be a grizzly conveyor, towards the opening 256 of the feed chute 208, in the first direction F1, which is an at least partly horizontal direction. Void spaces VS are formed between adjacent pieces of rock PR of the first type of material. The second type of material, i.e., oversized material recirculated via the second feeding device 217, is fed in the second direction F2, this second direction F2 being an at least partly horizontal direction, which is in this embodiment parallel to the first direction F1, towards the opening 256 of the feed chute 208. The second type of material may, in this example, have an average particle size of 60 mm. Hence, the first and second types of material are both fed to one and the same opening 256. At the inside of the feed chute 208 the second type of material falls off from the conveyor belt 203, and falls vertically down on top of the first type of material. Pebbles PS of the oversized material, i.e., the second type of material, will fall into the void spaces VS formed between the pieces of rock PR of the first type of material. This process starts in the feed chute 208 and may continue also in the inlet portion 254 of the crushing chamber 210. The fact that the pebbles PS are distributed in the void spaces VS formed between the pieces of rock PR results in an even distribution of the pebbles PS across the width of the crushing chamber 210 in accordance with principles that are similar to those described hereinbefore with reference to FIG. 6. Hence, the first type of material, which is the coarse material fed in the direction F1, has a larger average particle size than the second type of material, which is the recirculated oversized material fed in the direction F2 on top of the first type of material, and forms void spaces VS that aids in the distribution of the second type of material across the width WD of the crushing chamber 210.

The mixture of the first and second types of material then reaches the impeller 204, is impacted by the beater elements 246, and crushing commences.

In accordance with an alternative embodiment a third type of material could be fed to the crusher 201, such third type of material having a smaller average particle size than the second type of material. In accordance with a first alternative embodiment such third type of material could be fed, via a third feeding device 221, to the feed chute 208 via an optional second horizontal opening 258. In accordance with a second alternative embodiment such third type of material could be fed, via a fourth feeding device 223, to the feed chute 208 via the vertical opening 256. In both cases it is preferable that the third type of material is fed on top of the second type of material, such that the third type of material is distributed in void spaces VS formed between the pieces of rock PR, and/or in further void spaces formed between the pebbles PS. The third type of material could be a further oversized fraction, obtained from an optional further sieve 225 arranged downstream of the sieve 211. The optional further sieve 225 would have a smaller mesh size than the sieve 211. Oversized material, i.e., material that will not pass through the sieve 225, will be forwarded to further reject material container 227, and be recirculated to the crusher 210 by the third or fourth feeding device 221, 223.

It will be appreciated that numerous modifications of the embodiments described above are possible within the scope of the appended claims.

Hereinbefore it has been described, as illustrated in FIGS. 2*a* and 3*a*, that the first and second openings 56, 58 are completely separated from each other. It will be appreciated that it would also be possible to arrange the first and second openings 56, 58 in such a manner that a part of the first opening would also form a part of the second opening.

Hereinbefore it has been described that the crushing chamber shields 72, 74 comprises rubber strips and chains 80, respectively. It will be appreciated that other types of shields could be used, and in other combinations.

Hereinbefore it has been described that the first and second types of material could be supplied to separate openings 56, 58 of a feed chute 8, as illustrated in FIG. 5, or to a common vertical opening 256 of a feed chute 208, as illustrated in FIG. 7. It will be appreciated that it is also possible to supply the first and second types of material to a common horizontal opening, for example the horizontal opening 58 of the feed chute 8, when the feed chute 8 is arranged in accordance with the illustration of FIGS. 3*a*-3*c*.

Hereinbefore it has been described that a second cover 60 is arranged over the horizontal second opening 58 when the HSI-crusher 1 is to operate in the primary crushing setting. In accordance with one embodiment, the horizontal second opening 58 could be left open during primary crushing, since the material would be fed via the first opening 56, arrow F1 in FIGS. 1 and 2*c*, and below the second opening 58. Optionally, a further crushing chamber shield, for example of the first or second shield type 72, 74, could be mounted to the rear roof portion 92 to reduce the risk that material is, during such primary crushing setting, thrown out of the second opening 58. Still further, in accordance with a yet further embodiment, the vertical first opening 56 could be left entirely or partly open during secondary crushing, in cases where a risk that some material supplied to the second opening 58 would inadvertently leave the feed chute 8 via the first opening 56 is acceptable.

Hereinbefore it has been described that the first crushing setting is a primary crushing setting, and that the second crushing setting is a secondary crushing setting. It will be appreciated that the first and second crushing settings may also be other types of crushing settings. For example, the first crushing setting could be a first type of primary crushing setting, for crushing a first type of coarse material, and the second crushing setting could be a second type of primary crushing setting, for crushing a second type of coarse material, being different from the first type of coarse material.

The invention claimed is:

1. A method of feeding material to be crushed to a horizontal shaft impact crusher, the method comprising:

providing a horizontal shaft impact crusher, the horizontal shaft impact crusher including an impeller rotating around a horizontal shaft and at least one curtain against which material may be crushed;

feeding a first material to be crushed to a crushing chamber of the horizontal shaft impact crusher;

simultaneously therewith feeding a second material to be crushed to the crushing chamber, wherein the second material has a smaller average particle size than the first material, the first material having void spaces formed between pieces of the first material, the second material being fed on top of the first material to distribute pieces of the second material in the void spaces of the first material, such that the first and second materials are both evenly distributed across a width of the crushing chamber; and at least partially mixing the first and the second materials with each other before bringing them into contact with the impeller.

2. The method according to claim 1, further comprising feeding the first material and the second material separated from each other to a horizontal shaft impact crusher feed chute.

3. The method according to claim 2, further comprising at least partly mixing the first material and the second material with each other in the feed chute.

4. The method according to claim 1, further comprising at least partly mixing the first material and the second material with each other in an inlet portion of the crushing chamber.

5. The method according to claim 1, further comprising screening crushed material leaving the crushing chamber, and recirculating an oversize material fraction of the crushed material to form the second material and feeding the same to the horizontal shaft impact crusher.

6. The method according to claim 1, further comprising feeding the first material to a first opening of a horizontal shaft impact crusher feed chute of the horizontal shaft impact crusher, and feeding the second material to a second opening of the feed chute.

7. The method according to claim 6, further comprising feeding the first material to a vertical first opening of the feed chute, and feeding the second material to a horizontal second opening of the feed chute.

8. The method according to claim 1, wherein the first material has a maximum particle size of 20-1200 mm, and wherein at least 75% by weight of the crushed material has a particle size of 5 mm or larger.

9. A crushing device comprising:

a horizontal shaft impact crusher having an impeller rotating around a horizontal shaft;

at least one curtain against which material may be crushed;

a first feeding device arranged to feed a first material to be crushed to a crushing chamber of the horizontal shaft impact crusher;

a second feeding device arranged to feed a second material, having a smaller average particle size than the first material, to the crushing chamber simultaneously with the first feeding device feeding the first material to the crushing chamber; and a mixing arrangement arranged to at least partially mix the first and the second materials with each other before bringing them into contact with the impeller, the first material having void spaces formed between pieces of the first material, wherein the second feeding device is arranged to feed the second material on top of the first material to distribute pieces of the second material in void spaces of the first material, such that the first and second materials are both evenly distributed across a width of the crushing chamber.

10. The crushing device according to claim 9, wherein the first and the second feeding devices are arranged to feed the first material and the second material separated from each other to a horizontal shaft impact crusher feed chute.

11. The crushing device according to claim 9, wherein the mixing arrangement includes at least one of a horizontal shaft impact crusher feed chute and an inlet portion of the crushing chamber.

12. The crushing device according to claim 9, further comprising a screening device arranged to screen crushed material, and a recirculation system arranged to recirculate oversized material as said second material from the screening device to the horizontal shaft impact crusher.

13. The crushing device according to claim 9, further comprising a horizontal shaft impact crusher feed chute having a first opening and a second opening, wherein the first feeding device is arranged to feed the first material to the first opening, and the second feeding device is arranged to feed the second material to the second opening.

14. The crushing device according to claim 13, wherein the first opening is a vertical opening, and wherein the second opening is a horizontal opening.

* * * * *